US012638011B2

(12) United States Patent
Wang

(10) Patent No.: US 12,638,011 B2
(45) Date of Patent: May 26, 2026

(54) PRESS STRUCTURE FOR PUMP HEAD

(71) Applicant: BETO ENGINEERING & MARKETING CO., LTD., Taichung City (TW)

(72) Inventor: Lopin Wang, Taichung City (TW)

(73) Assignee: BETO ENGINEERING & MARKETING CO., LTD., Taichung City (TW)

( * ) Notice: Subject to any disclaimer, the term of this patent is extended or adjusted under 35 U.S.C. 154(b) by 417 days.

(21) Appl. No.: 18/172,523

(22) Filed: Feb. 22, 2023

(65) Prior Publication Data

US 2024/0191706 A1 Jun. 13, 2024

(30) Foreign Application Priority Data

Dec. 7, 2022 (TW) ..... 111146908

(51) Int. Cl.
*F04B 39/10* (2006.01)
*F04B 33/00* (2006.01)

(52) U.S. Cl.
CPC ..... *F04B 39/10* (2013.01); *F04B 33/005* (2013.01); *Y10T 137/3724* (2015.04)

(58) Field of Classification Search
CPC .. F04B 33/005; F16K 15/20; Y10T 137/3584; Y10T 137/3724
See application file for complete search history.

(56) References Cited

U.S. PATENT DOCUMENTS 605,238 A * 6/1898 Sutfin ..... F16L 37/252 137/231
1,210,538 A * 1/1917 Rose ..... B60S 5/043 285/310
1,797,383 A * 3/1931 Wahl ..... F16L 37/12 137/231
5,928,443 A * 7/1999 Jorda ..... B60C 29/064 152/415
6,146,116 A * 11/2000 Wu ..... F04B 33/005 137/231
2008/0190489 A1* 8/2008 Wrubel ..... F16L 37/35 251/149.1
2017/0122452 A1* 5/2017 Wang ..... F04B 33/005
(Continued)

FOREIGN PATENT DOCUMENTS

CN 107143673 A 9/2017
TW 201445067 A 12/2014

*Primary Examiner* — Robert K Arundale
(74) *Attorney, Agent, or Firm* — Guice Patents PLLC

(57) ABSTRACT

A press structure for a pump head comprises a base body provided with a hollow space portion disposed with an air inlet and at least one air outlet, at least one supporting portion is disposed on an outer side of the base body; at least one hanging arm having a force-bearing end and a clamping end, the hanging arm is disposed on the supporting portion, the force-bearing end can be pressed by using the supporting portion as a fulcrum, the clamping end is disposed on an outer side of the air outlet, when the force-bearing end is pressed, the clamping end displaces away from the air outlet; and at least one elastic member elastically pushing the force-bearing end to make the clamping end move towards the air outlet, when the force-bearing end is pressed, the elastic member is compressed to generate an elastic restoring force.

18 Claims, 12 Drawing Sheets

(56) References Cited

U.S. PATENT DOCUMENTS

| | | | | |
|---|---|---|---|---|
| 2017/0276277 | A1* | 9/2017 | Wang | F04B 33/00 |
| 2019/0107225 | A1* | 4/2019 | Ward | F04B 33/005 |
| 2023/0115823 | A1* | 4/2023 | Hsu | F16K 15/205 137/614.03 |

* cited by examiner

PRESS STRUCTURE FOR PUMP HEAD

FIELD OF THE INVENTION

The invention is related to an inflating device, and more particularly to a press structure for a pump head capable of releasing an air nozzle through pressing for convenient use.

DESCRIPTION OF THE RELATED ART

In general air pumps, especially manual air pumps for bicycle tire, in order to increase the airtight effect of the air nozzle and the pump nozzle and to prevent the pump nozzle from ejecting out of the air nozzle due to excessive pressure during the inflation process, a locking device is provided on the pump nozzle of the air pump. The locking device has a cam knob, locking or loosening effect is produced on the locking device through the cam knob, when the locking device is in the locked state, the pump nozzle is tightly inserted into the air nozzle, and can supply air to the air nozzle. At this time, because the air nozzle is fixed, there will be no air leakage or separation between the air nozzle and the pump nozzle due to excessive air pressure of the pump nozzle.

However, the cam knob of the locking device requires a longer force-applying arm in order to facilitate applying of force and rotation, so the overall volume will be relatively increased. Furthermore, through the eccentric acting force of the cam knob, it takes a relatively greater strength to turn the cam knob for locking or loosening, and therefore it is rather difficult for the user to manipulate.

SUMMARY OF THE INVENTION

An object of the invention is to provide a press structure for a pump head capable of locking or releasing the pump head by means of a lever.

A press structure for a pump head provided by the invention comprises:

- a base body provided with a hollow space portion inside, the hollow space portion is disposed with an air inlet and at least one air outlet, at least one supporting portion is disposed on an outer side of the base body;
- an inflating unit having at least one valve plug disposed on an inner side of each of the air outlets, an interface is provided on the valve plug;
- at least one hanging arm having a force-bearing end and a clamping end, each of the hanging arms straddles the supporting portion of the base body, the force-bearing end is pressed by using the supporting portion as a fulcrum, the clamping end is disposed on an outer side of the interface of the valve plug, when the force-bearing end is pressed, the clamping end displaces away from a direction of the interface; and
- at least one elastic member elastically pushing the force-bearing end to make the clamping end move toward a direction of the interface, when the force-bearing end is pressed, the elastic member is compressed to generate an elastic restoring force.

With the above-mentioned design, the hanging arm of the invention can be manipulated by means of a lever. Through positional changes of the clamping end of each of the hanging arms, an air nozzle can be fixed or released, manipulation is simple and does not require too much force. The force-bearing end of the hanging arm is pressed toward the base body, which is ergonomic and easy to apply force, manipulation is done around the base body, thus a user can be prevented from touching external objects and it is easy to manipulate.

Preferably, further comprising at least one pressing member, each of the pressing members is disposed on a side of the force-bearing end of the corresponding hanging arm, each of the pressing members is capable of driving the force-bearing end to move, and each of the elastic members elastically butts against each of the pressing members.

Preferably, further comprising at least one pressing member, each of the pressing members is disposed on a side of the force-bearing end of the corresponding hanging arm, each of the pressing members is capable of driving the force-bearing end to move, and the force-bearing end of each of the hanging arms is provided with each of the elastic members.

Preferably, the elastic member is a spring.

Preferably, each of the pressing members is provided with at least one groove, and a tip of the force-bearing end of each of the hanging arms is accommodated in each of the grooves.

Preferably, the elastic member is integrally formed with each of the pressing members.

Preferably, each of the pressing members is protruded with a position-limiting plate, a chamber is correspondingly disposed on the base body; and the position-limiting plate is accommodated in the chamber.

Preferably, further comprising at least one end cap, each of the end caps is disposed on a periphery of each of the air outlets of the base body, a through hole is formed on each of the end caps and corresponds to the interface of the inflating unit, and each of the hanging arms is disposed between the base body and the end cap.

Preferably, a position-limiting groove is recessed on the outer side of the base body, each of the supporting portions is a supporting groove respectively disposed on an end surface of the air outlet of the base body and located on two sides of the position-limiting groove, two sides of each of the hanging arms are protrudingly provided with connecting ribs respectively, the connecting ribs are pivotally disposed in the supporting grooves, and each of the end caps covers on an outer side of each of the supporting grooves.

Preferably, the base body is provided with an external thread on each of the air outlets, and each of the end caps is provided with an internal thread, so that each of the end caps is screwed on an outer side of each of the air outlets.

Preferably, a position-limiting groove is recessed on the outer side of the base body, each of the supporting portions is a rib protruding in the position-limiting groove, and each of the hanging arms is positioned in the position-limiting groove.

Preferably, a position-limiting groove is recessed on the outer side of the base body, each of the supporting portions is a groove disposed on a side of the position-limiting groove, and each of the hanging arms is protrudingly provided with a connecting rib pivotally disposed in the groove.

Preferably, the base body is provided with the air outlet on at least one side of the air inlet; a hanging arm is provided on one side of each of the air outlets, and the elastic member is provided between each of the hanging arms and the base body.

Preferably, the base body is provided with the air outlet on at least one side of the air inlet; a hanging arm is respectively provided on two sides of each of the air outlets, and the elastic member is provided between each of the hanging arms on a same side and the base body.

Thereby, when an air nozzle is inserted into the interface of the inflating unit from the air outlet end, the clamping end of the hanging arm is capable of gripping the air nozzle at a position of the air outlet, so that the air nozzle can be fixed on the base body. After inflation is completed, it only needs to slightly apply a force to a position of the force-bearing end of the hanging arm, the clamping end will not grip on the air nozzle, so that the air nozzle can be quickly detached from the base body, enabling a user to be capable of quickly fixing or separating the air nozzle.

BRIEF DESCRIPTION OF DRAWINGS

In order to further understand the objects, features, and achieved efficacies of the invention, five preferred embodiments are described below for detailed explanation in conjunction with the drawings, in which.

DETAILED DESCRIPTION OF THE INVENTION

Figure 1:
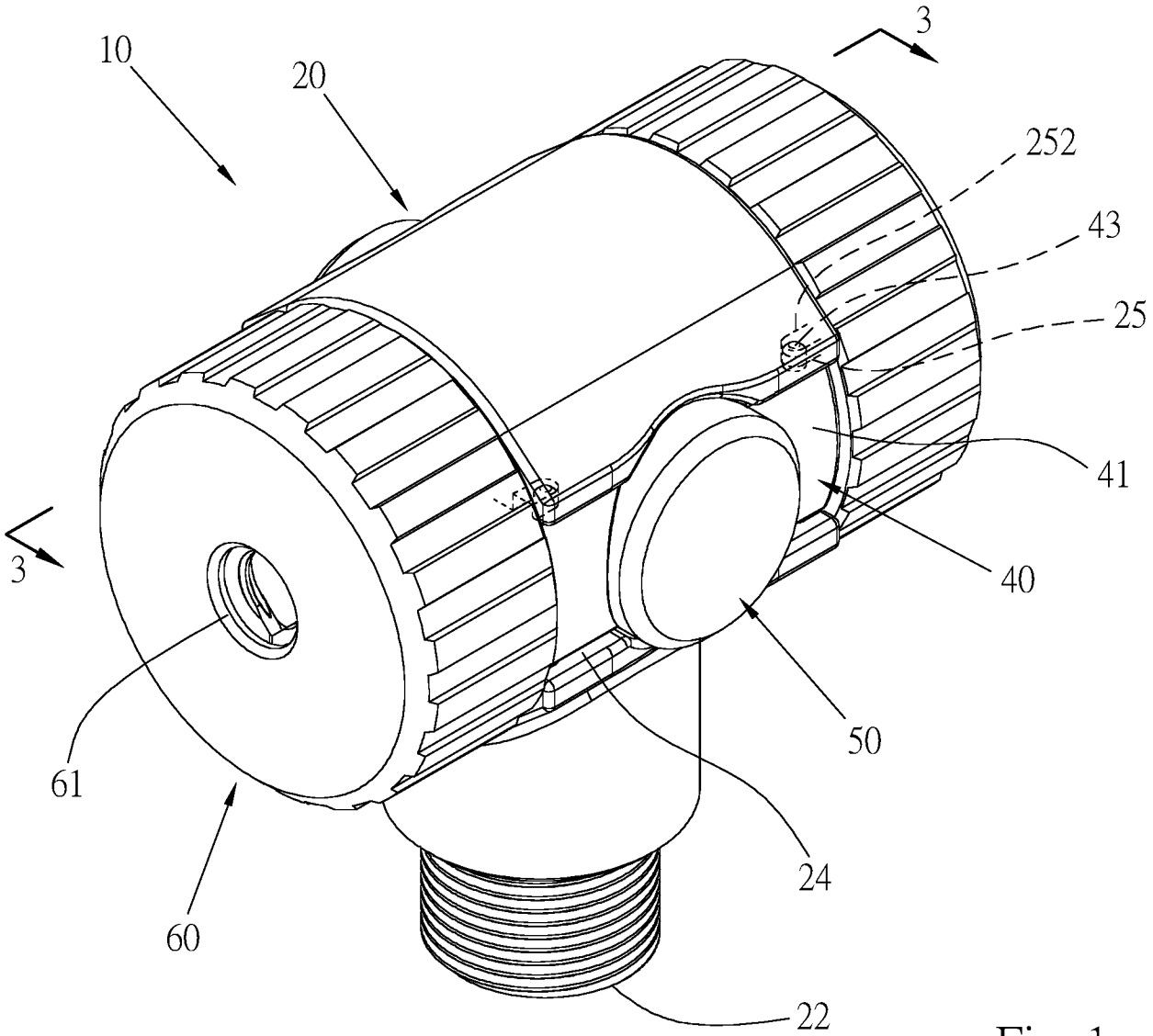
FIG. 1 is a perspective view of a pump head according to a preferred embodiment of the invention.
Figure 2:
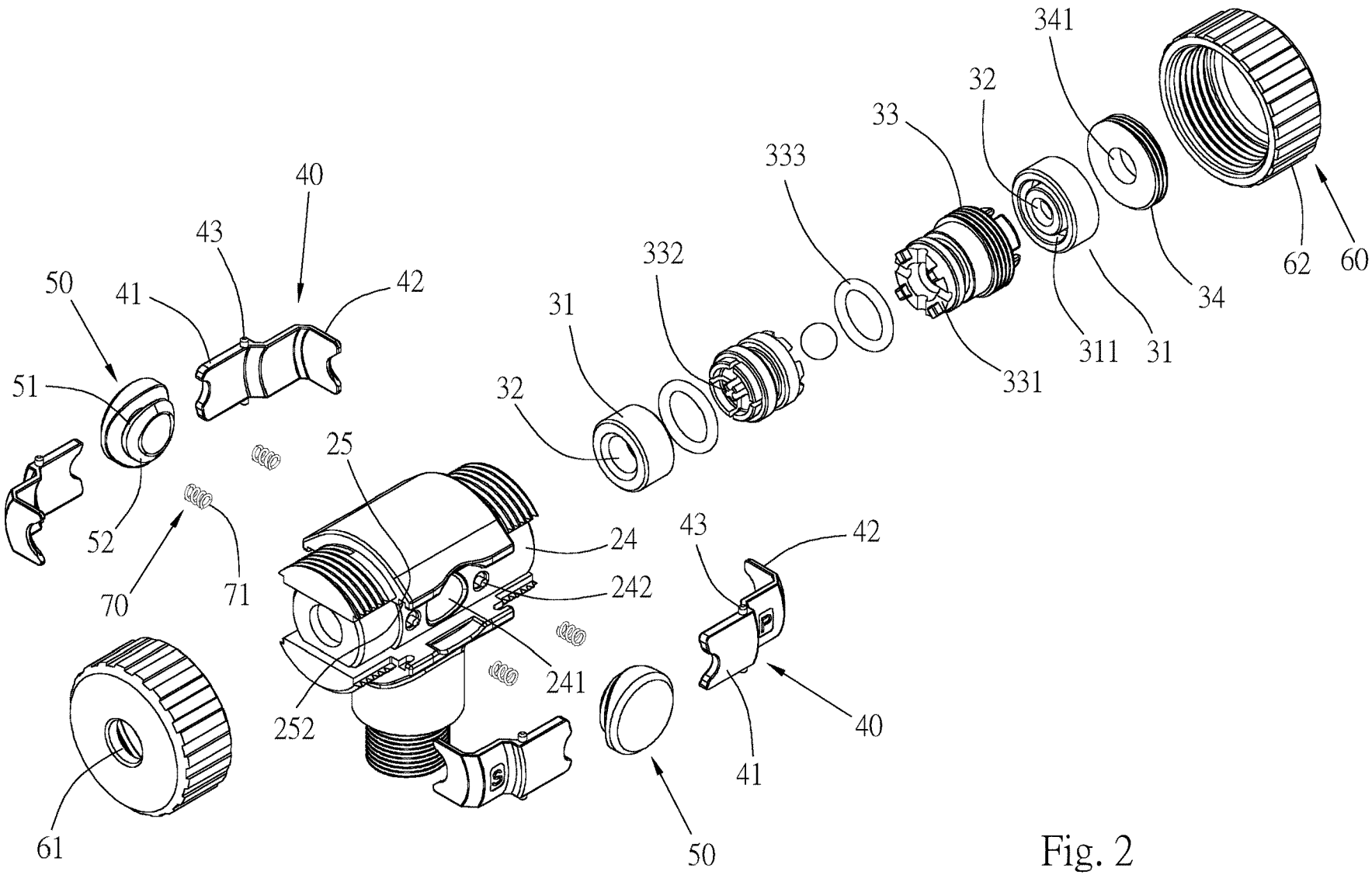
FIG. 2 is a perspective exploded view of the pump head according to a preferred embodiment of the invention.
Figure 3:
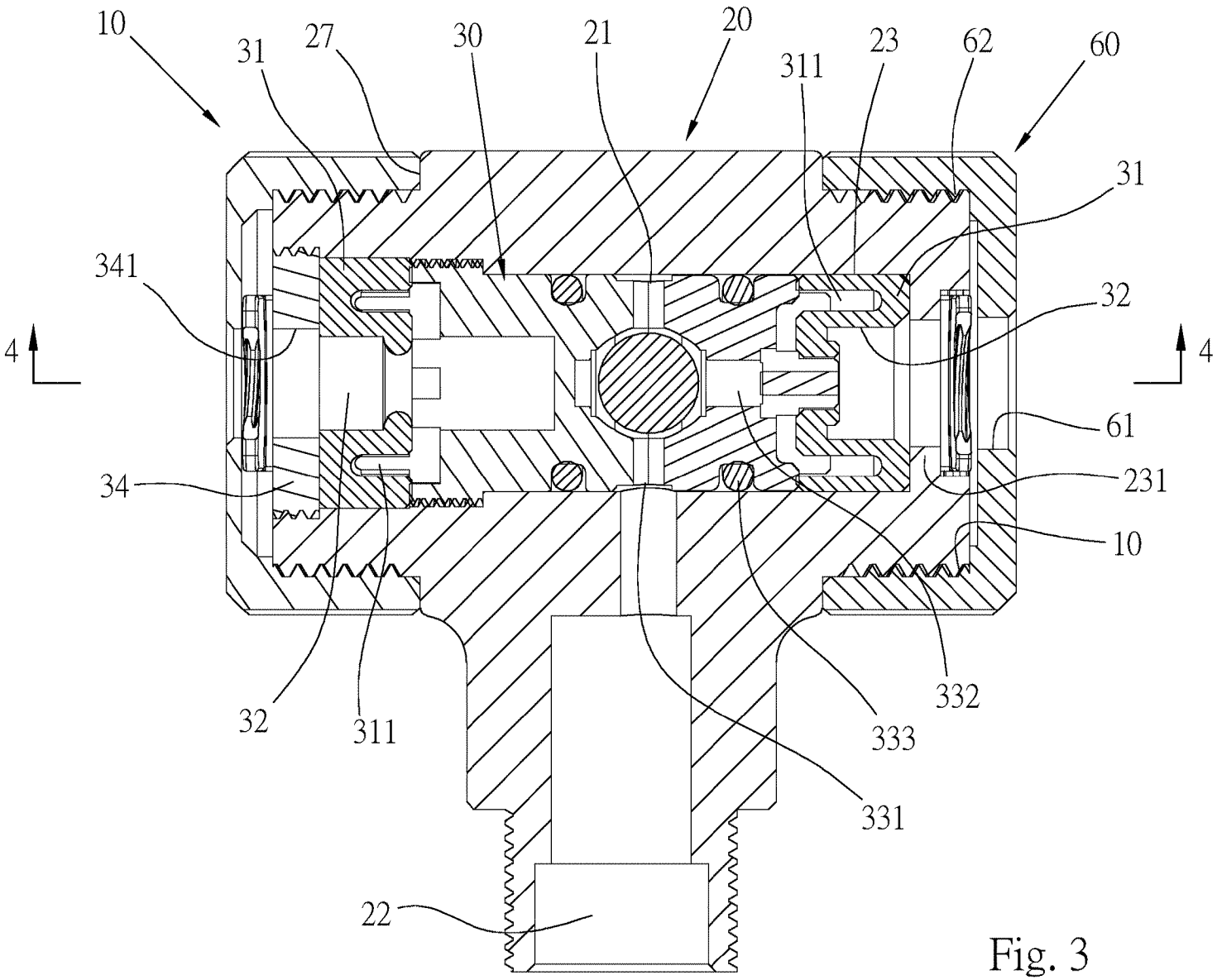
FIG. 3 is a cross-sectional view of the pump head of section line 3-3 in FIG. 1 according to a preferred embodiment of the invention.
Figure 4:
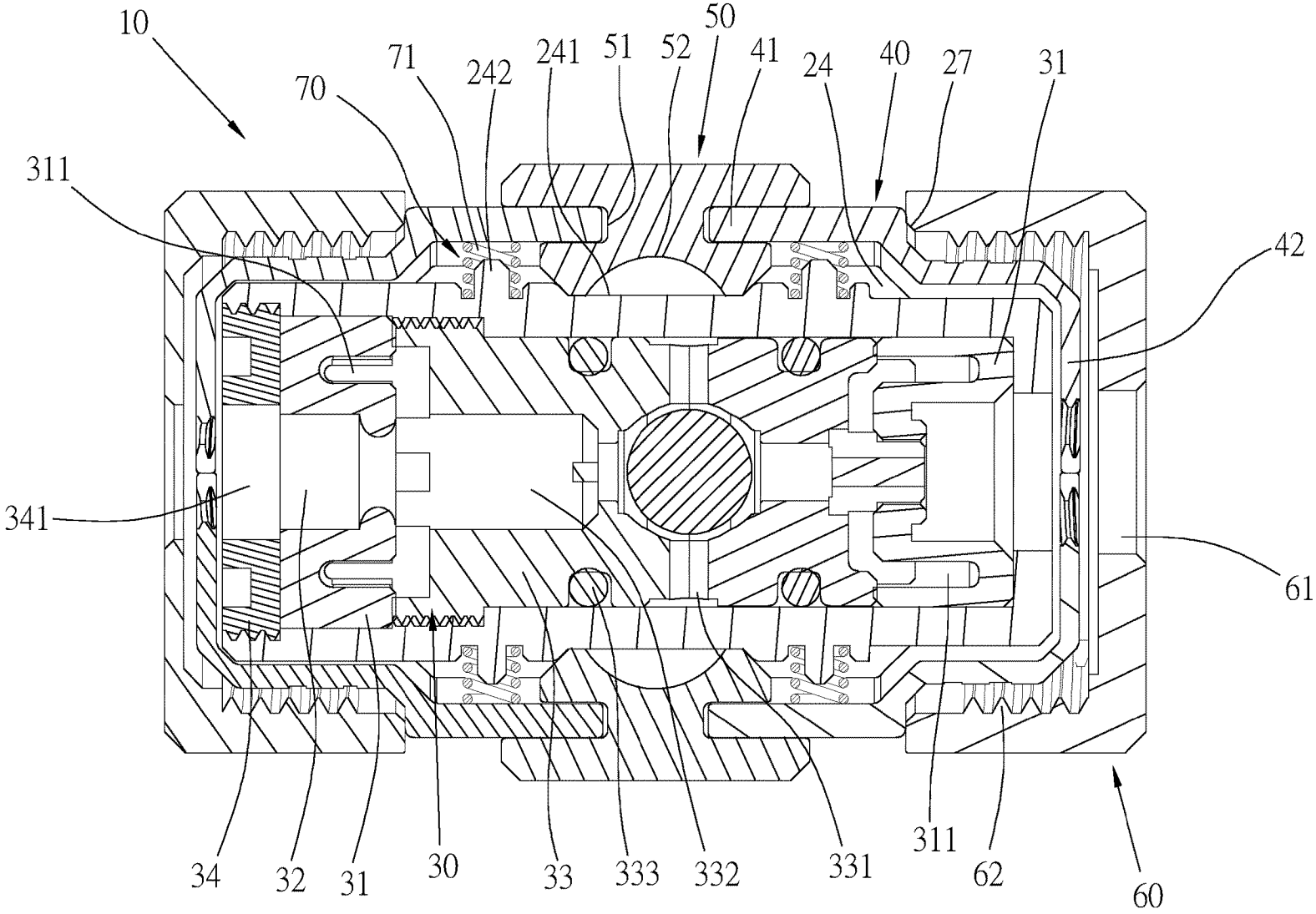
FIG. 4 is a cross-sectional view of the pump head of section line 4-4 in FIG. 3 in another direction according to a preferred embodiment of the invention.

Please refer to FIGS. 1 to 4, the invention provides a preferred embodiment of a pump head 10 for an inflator, the pump head 10 comprises a base body 20, an inflating unit 30, four hanging arms 40, two pressing member 50, two end caps 60, and four elastic members 70.

The base body 20 is roughly formed in a T-shape, and its interior is a hollow space portion 21. An air inlet 22 is provided at a bottom of the space portion 21 and an air outlet 23 is respectively disposed at two sides of the space portion 21, a blocking portion 231 is disposed around one of the air outlets 23, an aperture of the air outlet 23 with the blocking portion 231 is smaller than an aperture of the other air outlet 23, and an outer side of the base body 20 is concavely provided with two position-limiting grooves 24 along an axial direction of the two air outlets 23. A positioning portion 241 and two positioning posts 242 are respectively disposed on the position-limiting grooves 24 at a central position of the base body 20, and the two positioning posts 242 are located on two sides of the positioning portion 241. A supporting portion 25 is respectively disposed on one side of each of the two position-limiting grooves 24, and the two supporting portions 25 are respectively formed as a supporting groove 252 on sides of the position-limiting grooves 24. The base body 20 is respectively provided with an external thread 26 on an outer ring side of the two air outlets 23, the external thread 26 is higher than the position-limiting groove 24, the base body 20 is provided with a lip 27 protruding from an end of the external thread 26, and the supporting grooves 252 of the supporting portions 25 are respectively recessed on end sides of the lips 27 and located on two sides of the position-limiting grooves 24.

The inflating unit 30 is inserted into the space portion 21 of the base body 20 from an end side of the air outlet 23 with a larger aperture, has two valve plugs 31 respectively disposed on inner sides of the two air outlets 23, an interface 32 is respectively disposed at outer sides of the valve plugs 31 close to the two air outlets 23, and an inflatable groove 311 is respectively disposed on inner sides of the valve plugs 31 around the interfaces 32. The inflating unit 30 is connected with the two valve plugs 31 with a body 33, an air inlet passage 331 is disposed in a middle of the body 33, and an air outlet passage 332 is disposed at two sides of the body 33 respectively. The air inlet passage 331 communicates with the air inlet 22 of the base body 20, the two air outlet passages 332 communicate with the interfaces 32 of the two valve plugs 31 respectively, and the two air outlet passages 332 also communicate with the inflatable grooves 311 of the two valve plugs 31, so that air can be introduced into the air inlet passage 331 through the air inlet 22, and then guided to the air outlets 23 through the air outlet passages 332 to perform inflation. At the same time, the air is partially guided into the inflatable grooves 311 through the air outlet passages 332, after the inflatable grooves 311 are inflated, the valve plugs 31 are inflated and deformed under an action of air pressure. In addition, in order to achieve a good airtight effect, an airtight ring 333 is respectively provided on outer sides of the body 33 on two sides of the air inlet passage 331, and the two airtight rings 333 are capable of ensuring an airtight effect between the base body 20 and the inflating unit 30. The inflating unit 30 is also provided with a fixing member 34, the fixing member 34 is disposed at a position of the air outlet 23 with a larger aperture, an axis of the fixing member 34 is provided with a through hole 341 communicating with the interface 32, and the fixing member 34 can be fixed on the air outlet 23. The inflating unit 30 is a structure of a conventional inflator, which will not be repeated herein, and other similar structures with inflating effect can also be replaced as the inflating unit 30.

Each of the four hanging arms 40 has a force-bearing end 41 and a clamping end 42, the four hanging arms 40 are respectively formed into an L-shaped configuration, and the four hanging arms 40 are disposed in the two position-limiting grooves 24 of the base body 20, so that positions thereof can be fixed and are prevented from moving sideway. Also, a connecting rib 43 is protrudingly provided between the force-bearing end 41 and the clamping end 42 and on two sides of each of the four hanging arms 40, and the connecting ribs 43 can be inserted toward a center of the base body 20 along a direction of the external thread 26 so that the connecting ribs 43 can be inserted into the supporting grooves 252 provided on the lips 27. The force-bearing ends 41 of the hanging arms 40 can be pressed toward a direction of the base body 20 by using the connecting ribs 43 as fulcrums, so that the hanging arms 40 are capable of swinging by using the two connecting ribs 43 as fulcrums, the force-bearing ends 41 of the hanging arms 40 are capable of moving toward a direction of the base body 20, and the clamping ends 42 of the hanging arms 40 are capable of moving away from an axis of the interface 32 (or the air outlet 23) by using the two connecting ribs 43 as axes. The clamping end 42 is disposed on an outer side of the interface 32 of the valve plug 31, when the force-bearing end 41 is pressed, the clamping end 42 displaces away from a direction of the interface 32.

The two pressing member 50 has two grooves 51 and an elastic portion 52, the two grooves 51 are connected to form an annular state, and the two grooves 51 can also be disposed separately without being connected. The two grooves 51 are respectively connected with the force-bearing ends 41 of the two hanging arms 40, so that the force-bearing ends 41 of the two hanging arms 40 can be driven by the pressing member 50 to generate displacement. The elastic portion 52 is integrally formed by the pressing member 50, that is, the pressing member 50 can be made of elastic rubber, and can also be composed of a metal plate concavely bent to have elasticity or a spring. The elastic portion 52 can be accommodated in the positioning portion 241 of the position-limiting groove 24 to be positionally fixed. When the pressing member 50 is pressed toward the base body 20, the elastic portion 52 will relatively generate an elastic force, enabling the pressing member 50 to bounce back in a direction away from the base body 20.

Each of the two end caps 60 has a through hole 61, an internal thread 62 is disposed on an inner side of each of the two end caps 60, and the internal threads 62 of the two end caps 60 are respectively screwed on the two external threads 26 of the base body 20. Since the position-limiting grooves 24 are lower than the external thread 26, when the four hanging arms 40 are installed in the position-limiting grooves 24, the four hanging arms 40 will not be interfered by the two end caps 60, so that the four hanging arms 40 are capable of displacing in the two end caps 60. Also, the clamping ends 42 of the four hanging arms 40 are disposed between the two end caps 60 and the inflating unit 30. After the end cap 60 is screwed on the external thread 26, an end of the end cap 60 butts against the lip 27 of the base body 20, and correspondingly, an opening of the supporting groove 252 will be closed, so that the hanging arms 40 do not fall off easily from the base body 20 after installation.

The four elastic members 70 are respectively disposed on the position-limiting grooves 24 of the base body 20 and the force-bearing ends 41 of the four hanging arms 40, the four elastic members 70 are formed by springs 71, one end of each of the springs 71 is disposed on the positioning post 242 of the position-limiting groove 24, and another end thereof elastically butts against the force-bearing end 41 of the hanging arm 40. When the force-bearing end 41 is pressed toward a direction of the position-limiting groove 24, the spring 71 is capable of producing an elastic restoring force to push the force-bearing end 41 back.

Figure 5:
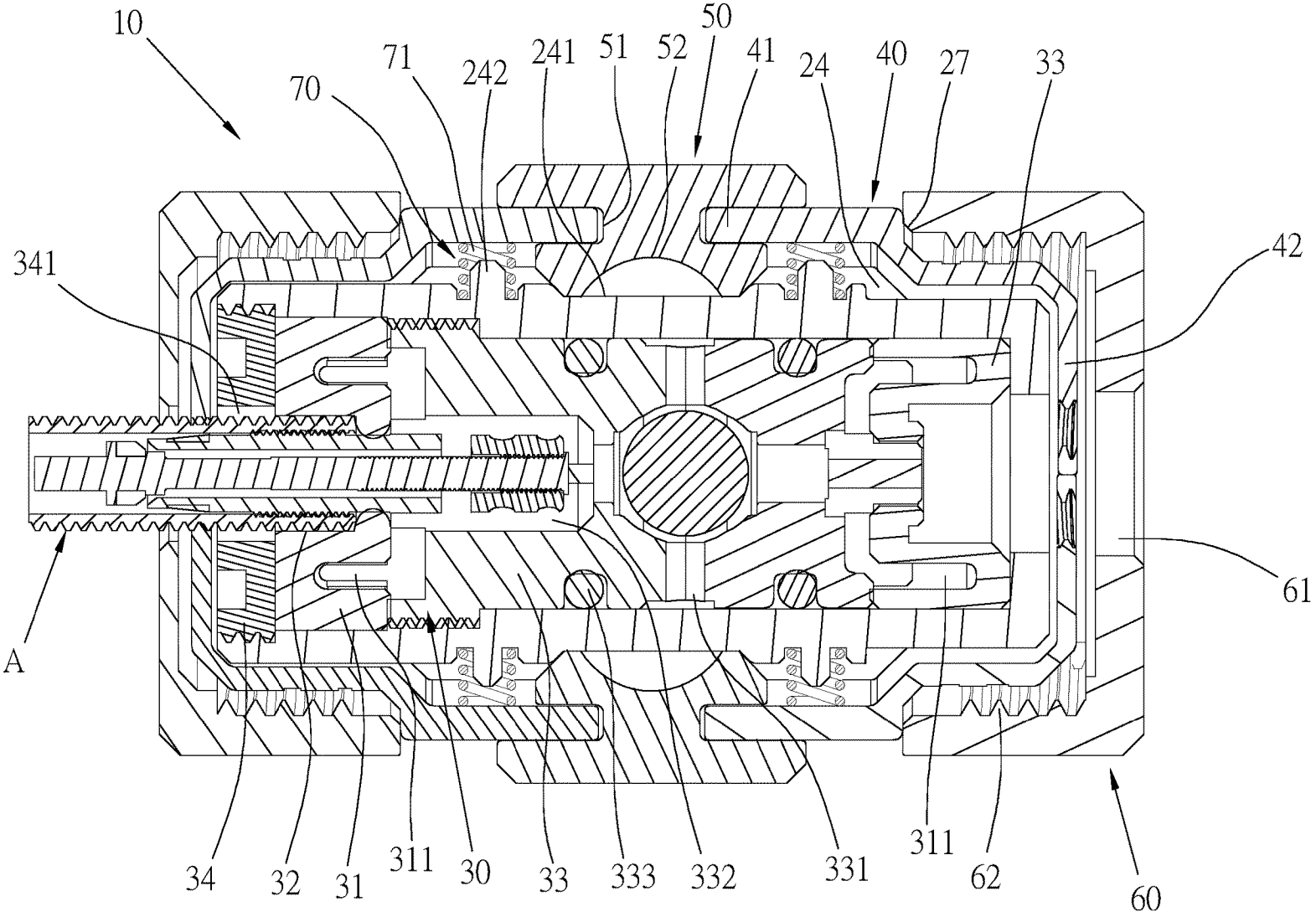
FIG. 5 is a schematic diagram of action of fixing a clamping end when inserting an air nozzle of the pump head according to a preferred embodiment of the invention.
Figure 6:
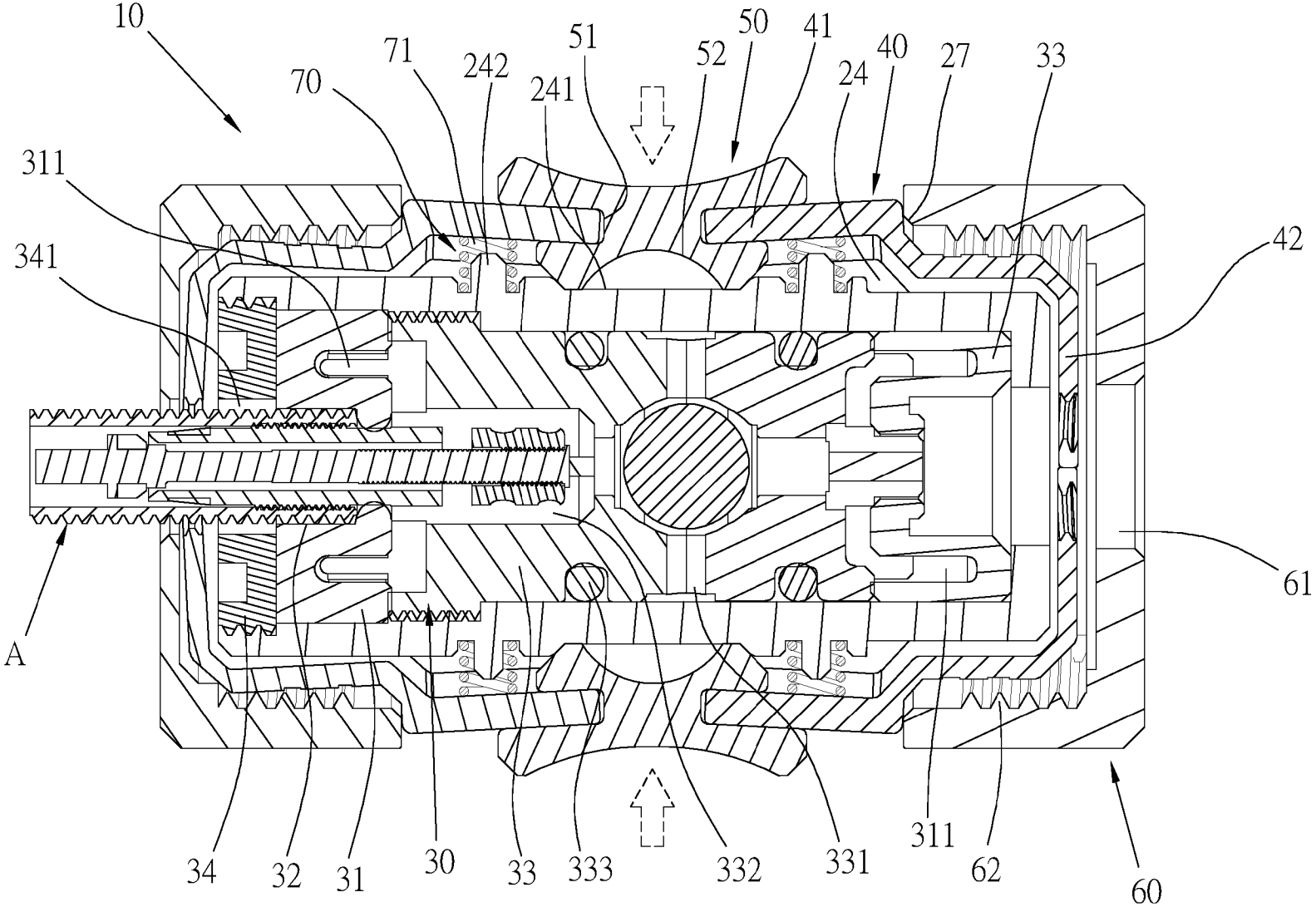
FIG. 6 is a schematic diagram of pressing action of a pressing member when pulling out the air nozzle of the pump head according to a preferred embodiment of the invention.

As shown in FIGS. 5 and 6, when an air nozzle A is inserted into the pump head 10, the air nozzle A will be inserted from the air outlet 23 of the base body 20. At this time, the two pressing members 50 are pressed to move the clamping ends 42 of the hanging arms 40 away from the air outlets 23, so that the air nozzle A can be inserted into the valve plugs 31 of the inflating unit 30, and the pump head 10 is capable of introducing air from the air inlet 22 of the base body 20 and sending it to the interfaces 32 of the valve plugs 31 through the inflating unit 30, and then introducing the air into the air nozzle A for inflation. After the air nozzle A is inserted into the interfaces 32, the two pressing members 50 are released, the elastic portions 52 on the pressing members 50 and the elastic members 70 will generate an elastic restoring force to push the force-bearing ends 41 of the hanging arms 40, so that the clamping ends 42 of the two hanging arms 40 that are in contact with the air nozzle A will be affected by an outer circumference of the air nozzle A and are capable of swinging by using the connecting ribs 43 disposed in the supporting grooves 252 of the supporting portions 25 as centers, and the force-bearing ends 41 will slightly press the elastic portions 52 of the pressing members 50 and the elastic members 70. After the air nozzle A is inserted into the interfaces 32 and positioned, the elastic portions 52 of the pressing members 50 and the springs 71 of the elastic members 70 will generate an elastic restoring force to push the force-bearing ends 41 of the hanging arms 40 outward, so that the clamping ends 42 at opposite ends of the hanging arms 40 will move toward the interfaces 32 of the valve plugs 31, and the clamping ends 42 can be affected by elastic force of the elastic portions 52 and the elastic members 70 to grip around an outer circumference of the air nozzle A, and therefore the clamping ends 42 are capable of fixing the air nozzle A, and the air nozzle A will not fall off from the base body 20. When the inflating unit 30 is inflating the interfaces 32, the air nozzle A can be kept fixed and will not be separated. In addition, during an inflating process, the air will also inflate the inflatable grooves 311 on the valve plugs 31, the inflatable grooves 311 are filled with the air and the valve plugs 31 can be deformed under force, so that the deformed valve plugs 31 can be combined more tightly with a periphery of the air nozzle A to form a good airtight effect.

After inflation is completed, when the air nozzle A is to be removed from the pump head 10, a user only needs to apply force to press the pressing members 50 so that the pressing members 50 can be pressed toward the base body 20, and the elastic portions 52 will be pressed to generate an elastic restoring force. When the pressing members 50 are pressed, the force-bearing ends 41 of the four hanging arms 40 on two sides of the pressing members 50 will move relatively toward the base body 20. The elastic members 70 are also compressed by being pressed by the force-bearing ends 41 of the hanging arms 40, so that the four hanging arms 40 are capable of rotating by using the connecting ribs 43 as centers. At this time, the clamping ends 42 of the four hanging arms 40 will move relatively away from the interfaces 32 of the inflating unit 30, so that the clamping ends 42 will not grip on the air nozzle A, and the air nozzle A can be pulled out from the interfaces 32 of the inflating unit 30. After pulling out the air nozzle A, the pressing members 50 are released, the elastic portions 52 will generate an elastic restoring force to push the pressing members 50 away from the base body 20, and the pressing members 50 will push the force-bearing ends 41 of the four hanging arms 40 away from the base body 20. At the same time, the elastic members 70 will also push the force-bearing ends 41 of the hanging arms 40 away from the base body 20, and the clamping ends 42 will relatively displace in a direction of the interfaces 32. Since the pressing members 50 are pressed toward the base body 20 during manipulation, manipulation is ergonomic and it is easy to press and apply force. In addition, when the pressing members 50 are manipulated, manipulation of the user's hand is carried out around the base body 20, it does not require much space, and during manipulation, it is unlikely for the user to come in contact with other items, such as spokes of bicycle tires.

Figure 7:
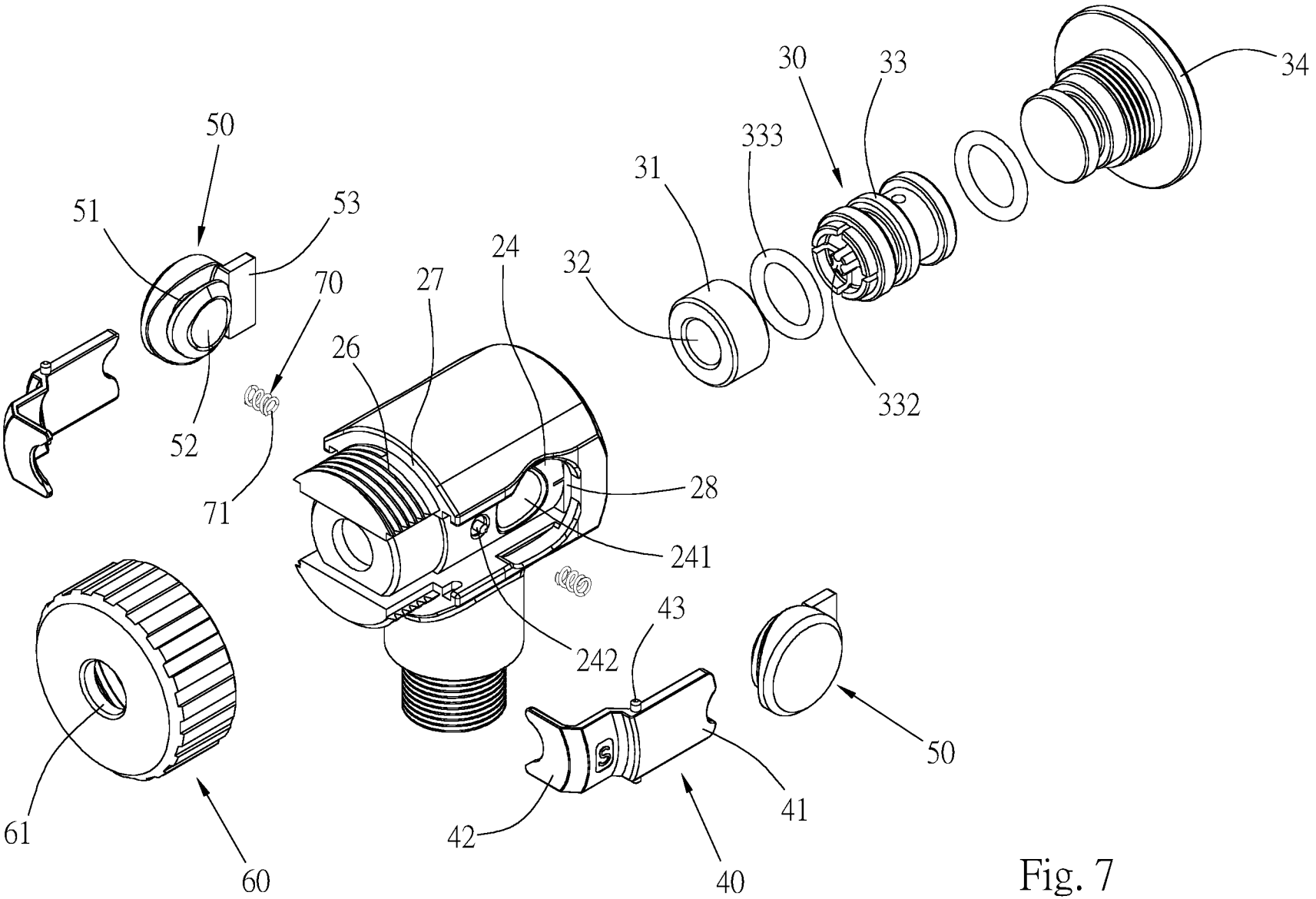
FIG. 7 is a perspective exploded view of the pump head according to a second preferred embodiment of the invention.
Figure 8:
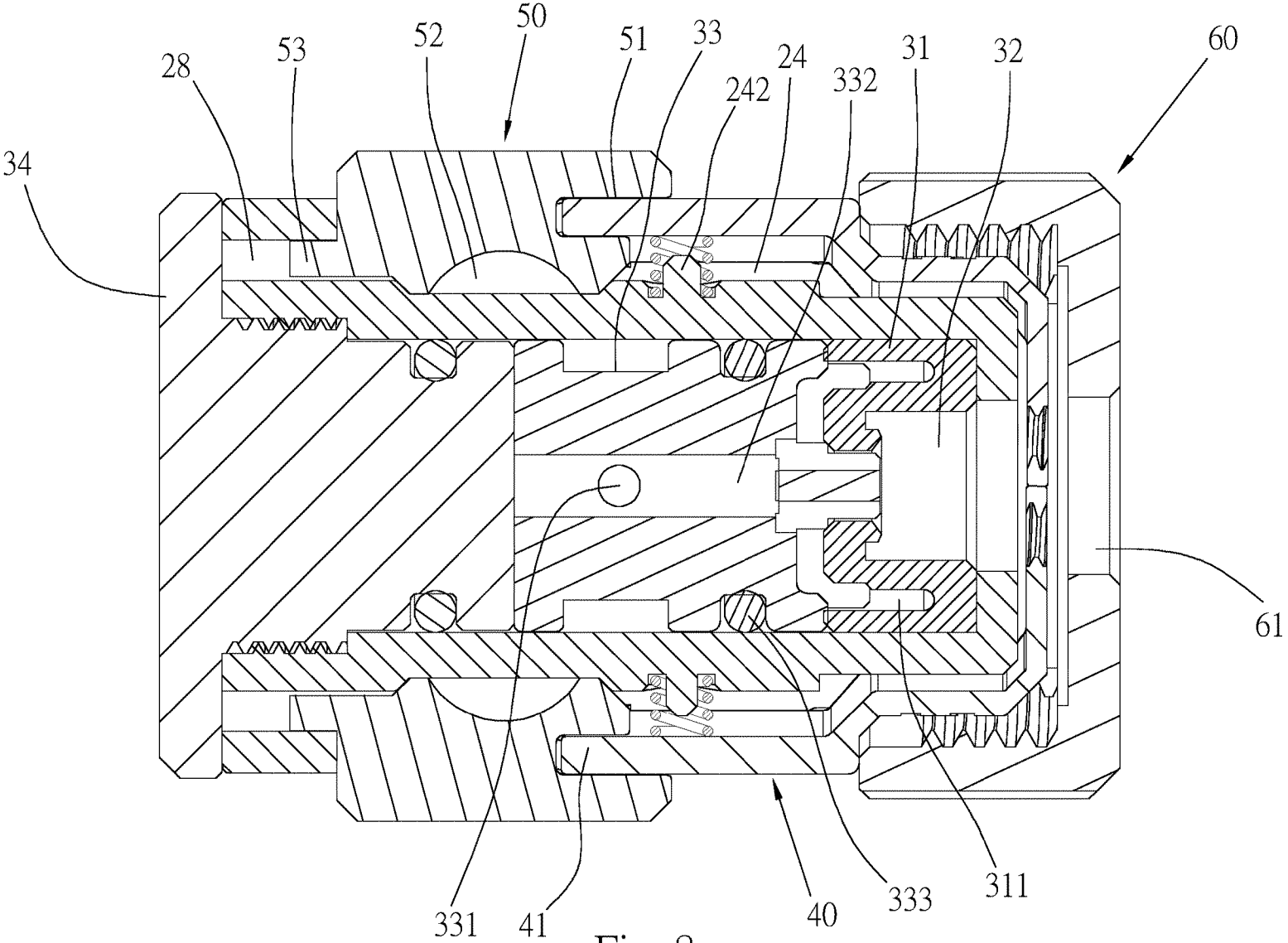
FIG. 8 is a cross-sectional view of the pump head according to the second preferred embodiment of the invention.

Please refer to FIGS. 7 and 8, which illustrate a second preferred embodiment of the pump head 10 of the invention. Its main structures are the same as those of the previous preferred embodiment, and the same components are represented by the same reference numerals, thus will not be repeated herein.

The base body 20 of the pump head 10 has only the single air outlet 23, so the pressing members 50 only drive the hanging arm 40, and the pressing members 50 are correspondingly provided with the single groove 51 to connect with the hanging arm 40. In order to fix a position of the pressing members 50 on the base body 20, a chamber 28 is provided on the base body 20 on a side of each the position-limiting grooves 24. The pressing members 50 are protruded with a position-limiting plate 53 corresponding to a position of the chambers 28, when the pressing members 50 are installed in the position-limiting grooves 24, the position-limiting plates 53 are installed in the chambers 28 of the base body 20, making the pressing members 50 to actuate within a fixed stroke in order to prevent the pressing members 50 from falling off. In addition, a center of the fixing member 34 is formed as a seal, preventing air of the inflating unit 30 from leaking from a side of the fixing member 34, besides that the sealed fixing member 34 is used for airtight fixing, alternatively, one side of the base body 20 can be directly disposed as a sealed end so that air cannot leak from the side.

Figure 9:
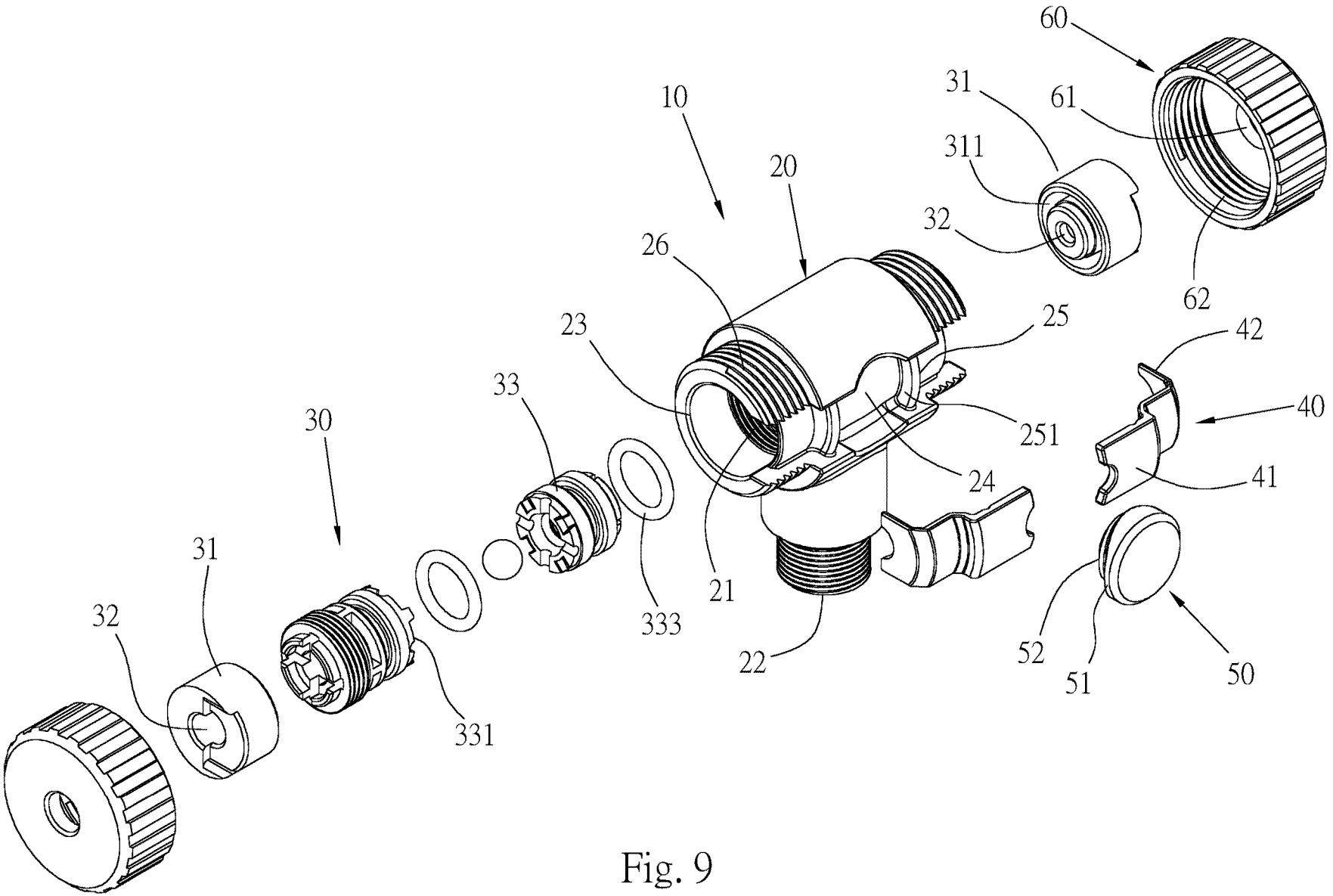
FIG. 9 is a perspective exploded view of the pump head according to a third preferred embodiment of the invention.
Figure 10:
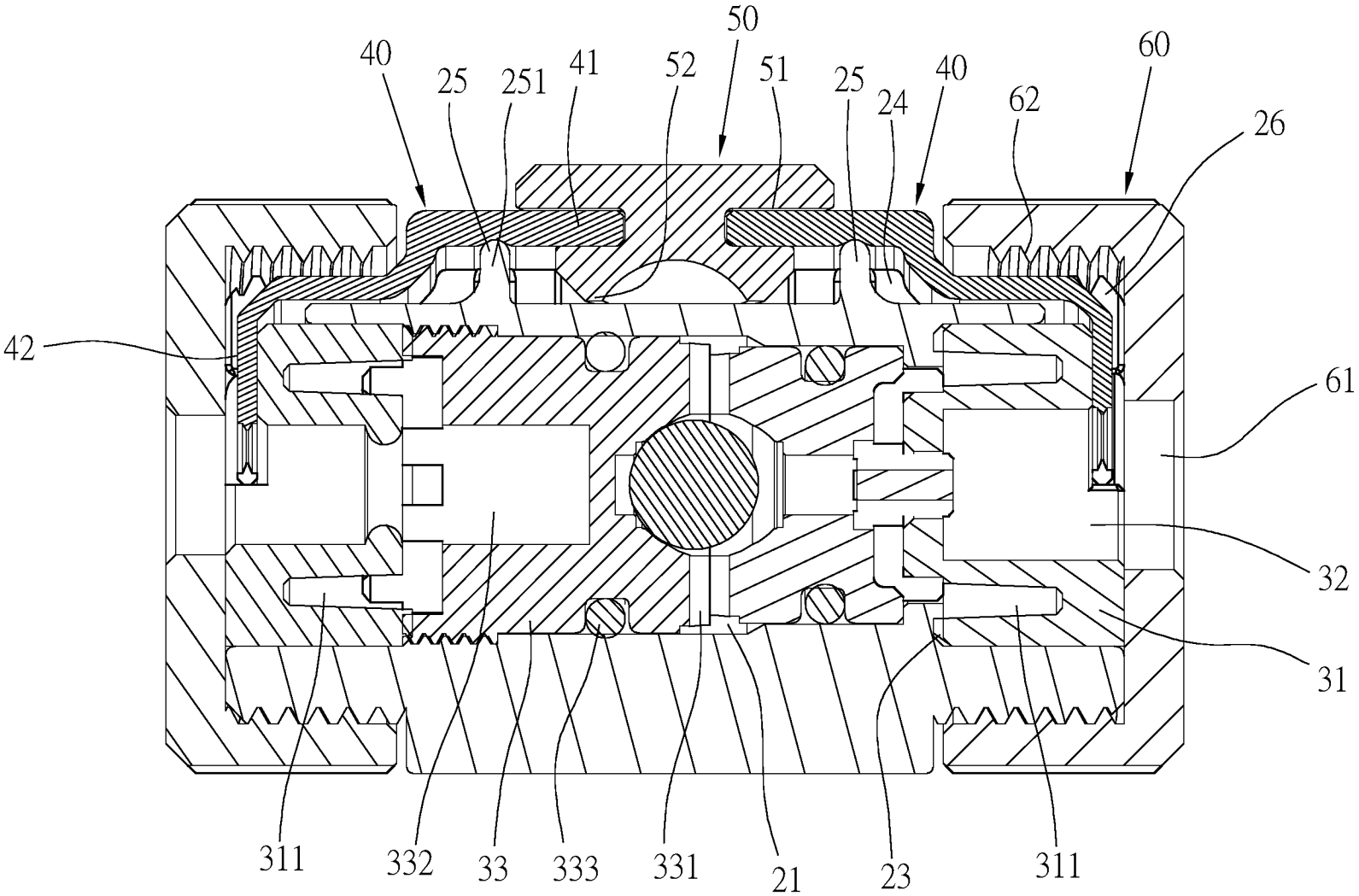
FIG. 10 is a cross-sectional view of the pump head according to the third preferred embodiment of the invention.

Please refer to FIGS. 9 and 10, which illustrate a third preferred embodiment of the pump head 10 of the invention. Its main structures are the same as those of the first preferred embodiment, and the same components are represented by the same reference numerals, thus will not be repeated herein.

The base body 20 has the two air outlets 23, the base body 20 is provided with the position-limiting groove 24 on one side of each of the two air outlets 23, the two supporting portions 25 protrude from the position-limiting groove 24 at positions corresponding to the two hanging arms 40, the two supporting portions 25 are respectively formed as a rib 251 in the position-limiting groove 24, and the two ribs 251 protrude from a bottom surface of the position-limiting groove 24. When the two hanging arms 40 straddle the two supporting portions 25, the two ribs 251 are disposed between the force-bearing end 41 and the clamping end 42, so that each of the two hanging arms 40 forms a swingable lever structure, and the force-bearing end 41 of the hanging arm 40 can be pressed toward the base body 20 by action of the pressing member 50 and by using the supporting portion 25 as a fulcrum. The clamping end 42 is disposed on an outer side of the interface 32 of the valve plug 31, when the force-bearing ends 41 are pressed by the pressing member 50, the hanging arms 40 will use the ribs 251 as axes, and drive the clamping ends 42 to displace away from a direction of the interfaces 32. At the same time, the pressing member 50 is capable of restoring the force-bearing ends 41 of the two hanging arms 40 to their normal positions through an elastic force of the elastic portion 52 at a bottom of the pressing member 50. In addition, the two air outlets 23 of the base body 20 have a same aperture, and are not provided with the blocking portion 231, the inflating unit 30 is correspondingly not provided with the fixing member 34, and the two end caps 60 on two sides are capable of limiting a position of the inflating unit 30.

Figure 11:
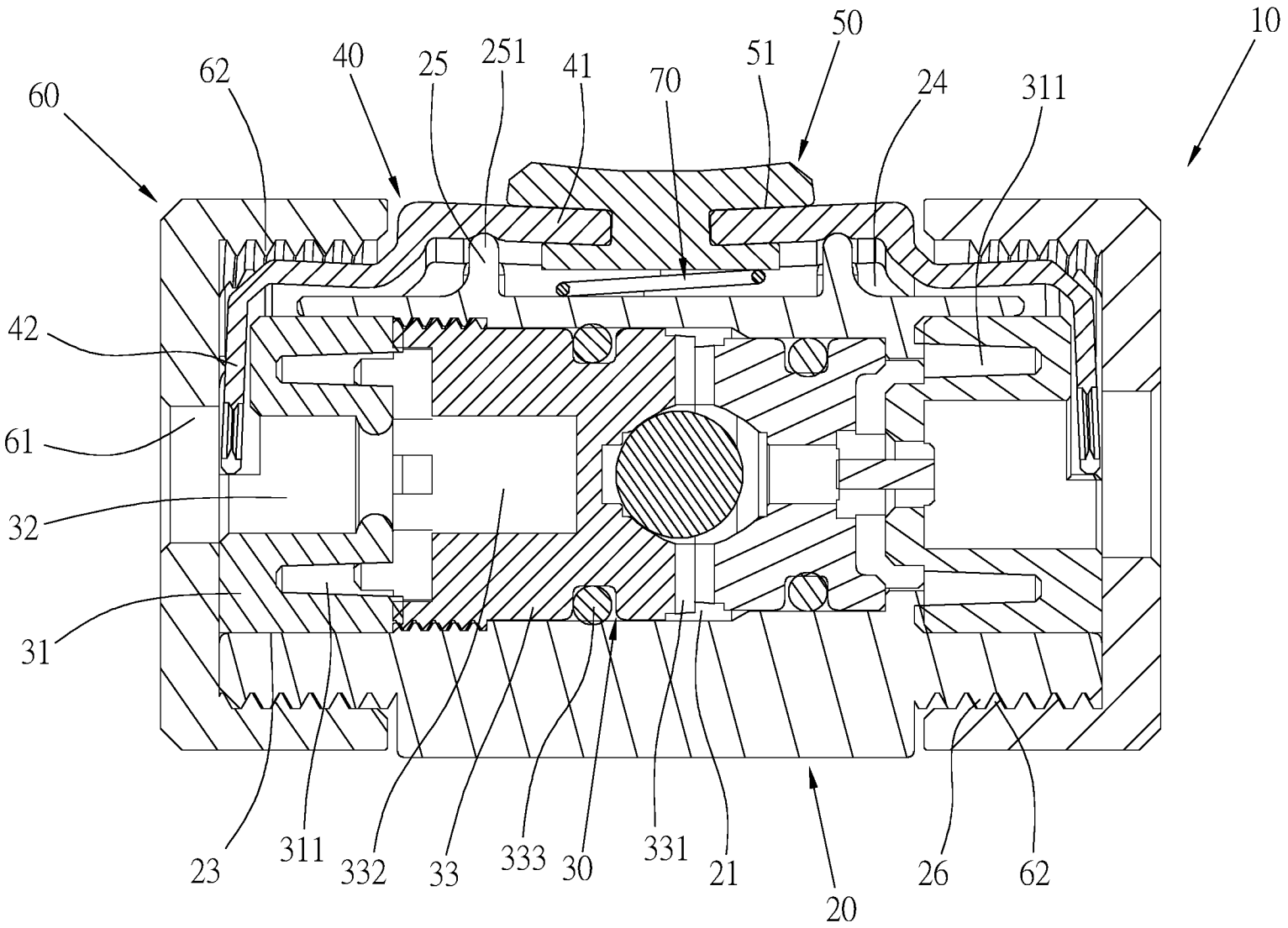
FIG. 11 is a cross-sectional view of the pump head according to a fourth preferred embodiment of the invention.

Please refer to FIG. 11, which illustrates a fourth preferred embodiment of the pump head 10 of the invention. Its main structures are the same as those of the previous preferred embodiment, and the same components are represented by the same reference numerals, thus will not be repeated herein.

The elastic member 70 is disposed between the base body 20 and the pressing member 50, the elastic member 70 is composed of the single spring 71, and the spring 71 is capable of generating an elastic force for the pressing member 50. When the pressing member 50 is exerted with a force, the elastic member 70 is compressed to generate an elastic restoring force.

Figure 12:
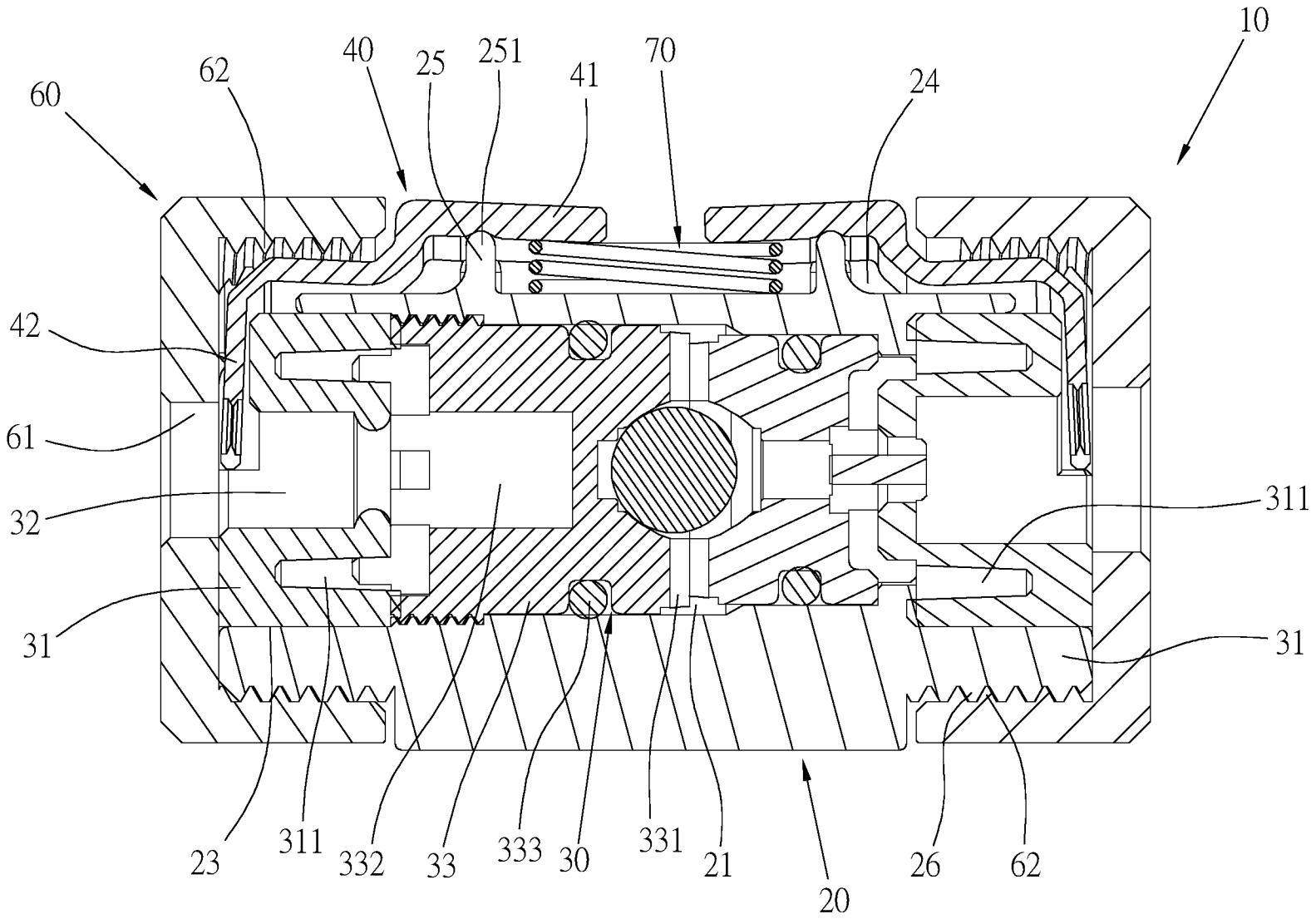
FIG. 12 is a cross-sectional view of the pump head according to a fifth preferred embodiment of the invention.

Please refer to FIG. 12, which illustrates a fifth preferred embodiment of the pump head 10 of the invention. Its main structures are the same as those of the fourth preferred embodiment, and the same components are represented by the same reference numerals, thus will not be repeated herein.

The elastic member 70 directly butts against a bottom of the force-bearing ends 41 of the hanging arms 40, and the pressing member 50 does not need to be provided. The user only needs to directly press an end position of the force-bearing ends 41, the clamping ends 42 will be lifted away from a position of the interface 32 by using the supporting portion 25 as a fulcrum, and the spring 71 is capable of generating an elastic force for the force-bearing ends 41 of the hanging arms 40. When the hanging arms 40 are exerted with a force, the elastic member 70 is compressed to generate an elastic restoring force.

What is claimed is:

1. A press structure for a pump head comprising:

a base body provided with a hollow space portion inside, the hollow space portion being disposed with an air inlet and at least one air outlet, at least one supporting portion being disposed on an outer side of the base body;

an inflating unit having at least one valve plug disposed on an inner side of each said at least one air outlet, an interface being provided on the valve plug;

at least one hanging arm having a force-bearing end and a clamping end, each said at least one hanging arm straddling the at least one supporting portion of the base body, the force-bearing end being pressed by using the at least one supporting portion as a fulcrum, the clamping end being disposed on an outer side of the interface of the valve plug, when the force-bearing end being pressed, the clamping end displacing away from a direction of the interface;

at least one elastic member disposed between the base body and each said corresponding at least one hanging arm and elastically pushing the force-bearing end to make the clamping end moving toward a direction of the interface, when the force-bearing end being pressed, the at least one elastic member being compressed to generate an elastic restoring force; and at least one end cap, each said at least one end cap being disposed on a periphery of each said at least one air outlet of the base body, a through hole being formed on each said at least one end cap and corresponded to the interface of the inflating unit, and each said at least one hanging arm being disposed between the base body and the said corresponding at least one end cap.

2. The press structure for the pump head as claimed in claim 1, further comprising at least one pressing member, each said at least one pressing member being disposed on a side of the force-bearing end of the corresponding at least one hanging arm, each said at least one pressing member being capable of driving the force-bearing end to move, and each said at least one elastic member elastically butting against each said corresponding at least one pressing member.

3. The press structure for the pump head as claimed in claim 1, further comprising at least one pressing member, each said at least one pressing member being disposed on a side of the corresponding force-bearing end, each of the pressing members said at least one pressing member being capable of driving the force-bearing end to move, and the force-bearing end of each said at least one hanging arm being provided with each said at least one elastic member.

4. The press structure for the pump head as claimed in claim 1, wherein each said at least one elastic member is a spring.

5. The press structure for the pump head as claimed in claim 2, wherein each said at least one elastic member is a spring.

6. The press structure for the pump head as claimed in claim 3, wherein each said at least one elastic member is a spring.

7. The press structure for the pump head as claimed in claim 2, wherein each said at least one pressing member is provided with at least one groove, and a tip of the force-bearing end of each said at least one hanging arm is accommodated in each said at least one groove.

8. The press structure for the pump head as claimed in claim 3, wherein each said at least one pressing member is provided with at least one groove, and a tip of the force-bearing end of each said at least one hanging arm is accommodated in each said at least one groove.

9. The press structure for the pump head as claimed in claim 2, wherein the at least one elastic member is integrally formed with each said at least one pressing member.

10. The press structure for the pump head as claimed in claim 3, wherein the at least one elastic member is integrally formed with each said at least one pressing member.

11. The press structure for the pump head as claimed in claim 2, wherein each said at least one pressing member is protruded with a position-limiting plate, a chamber is correspondingly disposed on the base body; and the position-limiting plate is accommodated in the chamber.

12. The press structure for the pump head as claimed in claim 3, wherein each said at least one pressing member is protruded with a position-limiting plate, a chamber is correspondingly disposed on the base body; and the position-limiting plate is accommodated in the chamber.

13. The press structure for the pump head as claimed in claim 1, wherein a position-limiting groove is recessed on the outer side of the base body, each said at least one supporting portion is a supporting groove respectively disposed on an end surface of the at least one air outlet of the base body and located on two sides of the position-limiting groove, two sides of each said at least one hanging arm are protrudingly provided with connecting ribs respectively, the connecting ribs are pivotally disposed in the supporting grooves, and each said at least one end cap covers on an outer side of each of the supporting grooves.

14. The press structure for the pump head as claimed in claim 1, wherein the base body is provided with an external thread on each said at least one air outlet, and each said at least one end cap is provided with an internal thread, so that each said at least one end cap is screwed on an outer side of each said at least one air outlet.

15. The press structure for the pump head as claimed in claim 13, wherein the base body is provided with an external thread on each said at least one air outlet, and each said at least one end cap is provided with an internal thread, so that each said at least one end cap is screwed on an outer side of each said at least one air outlet.

16. The press structure for the pump head as claimed in claim 1, wherein a position-limiting groove is recessed on the outer side of the base body, each said at least one supporting portion is a rib protruding in the position-limiting groove, and each said at least one hanging arm is positioned in the position-limiting groove.

17. The press structure for the pump head as claimed in claim 1, wherein the base body is provided with the at least one air outlet on at least one side of the air inlet; said at least one hanging arm is provided on one side of each said at least one air outlet, and the at least one elastic member is provided between each said corresponding at least one hanging arm and the base body.

18. The press structure for the pump head as claimed in claim 1, wherein the base body is provided with the at least one air outlet on at least one side of the air inlet; said at least one hanging arm is respectively provided on two sides of each said at least one air outlet, and the at least one elastic member is provided between each said corresponding at least one hanging arm on a same side and the base body.

* * * * *